United States Patent [19]

Zurcher

[11] 4,063,030

[45] Dec. 13, 1977

[54] DETECTION CIRCUIT FOR SIGNIFICANT PEAKS OF SPEECH SIGNALS

[76] Inventor: Jean-Frédéric Zurcher, 34, Residence Corlay, Lannion, France 22300

[21] Appl. No.: 735,788

[22] Filed: Oct. 26, 1976

[30] Foreign Application Priority Data

Nov. 25, 1975 France ..... 75.36006

[51] Int. Cl.[2] ..... G10L 1/00

[52] U.S. Cl. ..... 179/1 SC

[58] Field of Search ..... 179/1 SA, 1 SC, 1 SB

[56] References Cited

U.S. PATENT DOCUMENTS

| | | | |
|---|---|---|---|
| 3,377,428 | 4/1968 | Dertsch | 179/1 SC |
| 3,852,535 | 12/1974 | Zurcher | 179/1 SA |

*Primary Examiner*—Kathleen H. Claffy
*Assistant Examiner*—E. S. Kemeny

[57] ABSTRACT

A detection circuit for the significant peaks of a speech signal, comprising first and second detectors respectively for detecting the positive and negative peaks of said speech signal. Each of these detectors is followed by a peak charging circuit comprising a first integrator having a relatively large discharge time constant and a comparator comparing the detected speech signal and the output signal of said first integrator. Each peak charging circuit comprises in addition a second integrator having a relatively small time-constant. The discharge of the first integrator is effected up to a voltage equal to the output voltage of the second integrator, and the discharge of the second integrator is effected down to a voltage depending on the output voltage of the first integrator. The two integrators of each peak charging circuit provide a non-exponential decreasing signal which has an inflection point following a significant peak in the original speech signal.

4 Claims, 3 Drawing Figures

DETECTION CIRCUIT FOR SIGNIFICANT PEAKS OF SPEECH SIGNALS

BACKGROUND OF THE INVENTION

1. Field of the Invention

The present invention concerns a device, generally known as a "pitch detector" for determining the basic period of speech, and more particularly a device creating marking impulses corresponding to significant peaks in a speech signal.

2. Description of the Prior Art

In the U.S. Pat. No. 3,852,535, granted Dec. 12, 1974, there has been described a device for measuring the fundamental period or pitch of a speech signal. This device comprises essentially a processor of an analogue speech signal, a voicing or unvoicing detector, a circuit for detecting significant peaks of the previously treated speech signal giving pitch impulses coinciding with the significant peaks, and means for processing the said impulses.

The detection of the significant positive and negative peaks in a speech signal is generally effected, in particular in the device for measuring the fundamental period of a speech signal which is the subject of the aforesaid patent, by storing in an integrator the peak amplitudes and by applying to a comparator on the one hand the previously treated speech signal and on the other hand the output signal of the integrator which is a decreasing exponential signal departing from the amplitude of the stored peak. When the amplitude of a new peak of the speech signal and the amplitude of the decreasing exponential signal become equal the comparator delivers a pitch impulse.

The time constant of the decreasing exponential must be suitably regulated for the detection circuit to deliver only one pitch impulse, or two if need be, per pitch period. In the aforementioned patent this objective was approached by adding to the decreasing exponential signal a calibrated part of the speech signal.

OBJECT OF THE INVENTION

The object of the present invention is to reduce the number of pitch impulses per pitch period to one or two at a maximum so as to facilitate the subsequent treatment of the pitch impulses in the processor of these impulses. The detector circuit of significant peaks of the present invention is more effective than that of the aforementioned patent and it is capable of indicating the significant peaks of periodicity without the first harmonics of the fundamental frequency having to be weakened. The result is that instead of filtering the speech signal to be treated in a low pass filter having a cut off at 100 Hz as indicated in the aforesaid patent it is possible to cause the cut off frequency of this filter to pass at 400 Hz.

SUMMARY OF THE INVENTION

The detection circuit for the significant peaks of the speech signal of the present invention comprises essentially means for detecting the positive peaks and means for detection of the negative peaks of said speech signal; and two peak charging circuits respectively associated with said detecting means. Each peak charging circuit comprising a first and a second peak storing integrators having respectively a relatively large and a relatively small discharge time constant, the discharge of the first integrator causing a voltage equal to the output voltage of the second integrator, and a comparator comparing the speech signal detected and the output signal of the first integrator.

It follows from providing two integrators that the signal which is compared with the speech signal is no longer a decreasing exponential signal departing from the preceding significant peak amplitude with a slope which is always the same, but a signal which is the sum of two decreasing exponential signals having different logarithmic decrements and is of the form, that is to say, of $K_1e^{-p_1t} + K_2e^{-p_2t}$.

This wave form may be given a tangent horizontal to each instant of occurrence of a significant peak $U_{max}$ by taking $$A = \frac{-p_2}{p_1 - p_2} U_{max} \qquad B = \frac{p_1}{p_1 - p_2} U_{max}$$

On the other hand, this wave form has an inflection point at the instant $t$ following a significant peak, this instant being defined by $$t = \frac{\log p_1 - \log p_2}{p_1 - p_2}$$

BRIEF DESCRIPTION OF THE DRAWING

The invention will now be described in detail in relation to the annexed drawings in which:

FIG. 4A shows the equivalent electrical diagram of the detection circuit for significant peaks as shown in FIG. 3;

FIG. 4B shows an equivalent electrical diagram of the detection circuit to significant peaks derived from the circuit of FIG. 3; and FIGS. 5A and 5B are diagrams of signals for the explanation of the operation of the pitch detector of the invention.

BRIEF DESCRIPTION OF THE PREFERRED EMBODIMENT

A. EXPLANATION OF U.S. Pat. No. 3,852,535 DETECTOR

Figure 1:
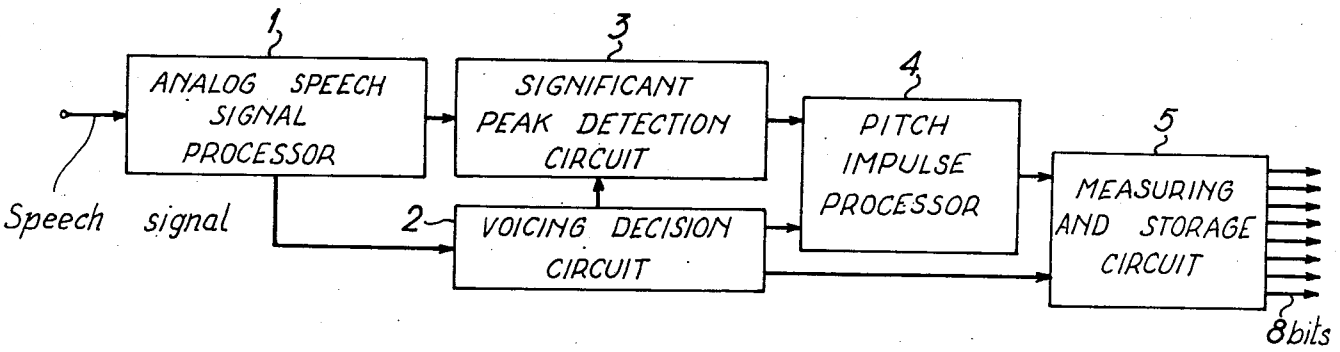
FIG.1 PRIOR ART
FIG. 1 is a block diagram of the measuring device for measuring the basic period or pitch of a speech signal according to the aforesaid U.S. Pat. No. 3,852,535.

FIG. 1 shows, in the form of blocks, the general arrangement of the device described in the aforesaid patent. This figure shows the processor 1 for processing the analog speech signals the voicing or unvoicing decision circuit 2 and the detection circuit 3 for detecting significant peaks in the speech signal. The two blocks 2 and 3 are connected to one another and to the processor 4 for processing pitch impulses, processor 4 being in communication with a measuring circuit and storing the fundamental period of the speech signal, circuit 5 also being controlled by the voicing or non-voicing decision circuit 2.

Figure 2:
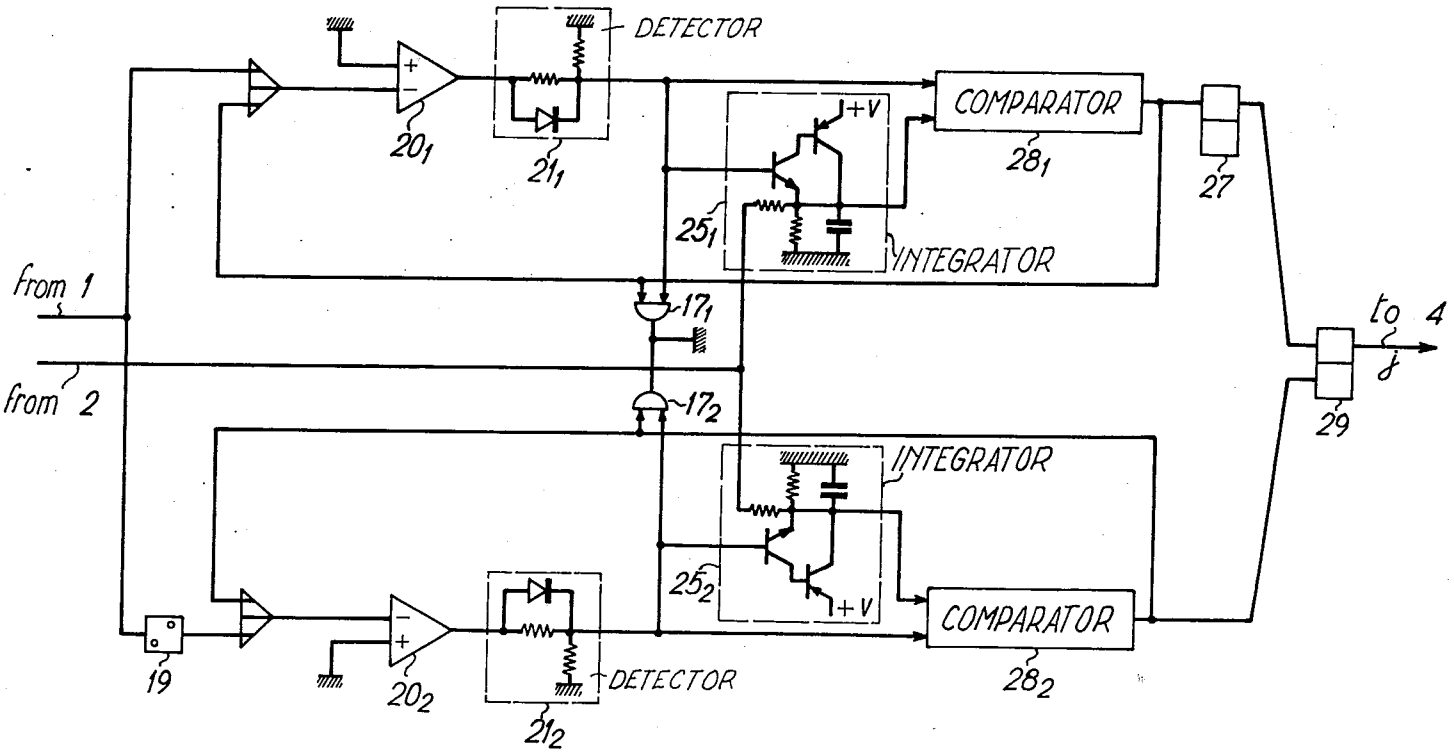
FIG.2 PRIOR ART
FIG. 2 shows the detection circuit for detecting significant peaks as used in the aforesaid U.S. Pat. No. 3,852,535.

FIG. 2 shows in the form of blocks, the diagram of the circuit 3 in the aforesaid patent. This circuit 3 receives at its input, signals referred to herein as S and P, coming respectively from the circuits 1 and 2 of FIG. 1.

The circuit of FIG. 2 is constituted by two chains of identical circuits with the exception that one of the chains includes in addition an analog inverter 19. The signal S coming from 1 undergoes therefore basically the same treatment in these two chains, the top chain being for the treatment of the positive peaks and the bottom chain for the negative peaks.

The amplifier $20_1$ is followed by a signal expander or stretcher $21_1$, having a diode connected with two resistances as shown. This expander of known type has the function of permitting the passage of positive peaks for which the diode has a weak resistance whilst the remainder of the signal is weakened by the high resistance of this diode. This expander renders therefore the peaks thinner so as better to define their position in time. The signal thus treated is applied to the first input of a comparator $28_1$. The output signal of expander $21_1$ is likewise applied to an integrator $25_1$ the output of whichis connected to the second input of the comparator $28_1$. The output of the comparator $28_1$ is connected to a gate $17_1$ for earthing the input of the integrator and to provide a feedback signal to the input of the amplifier $20_1$.

The chain for processing the negative peaks is similar and the reference numbers of its circuits bear the suffix 2. The outputs of the comparators $28_1$ and $28_2$ are respectively connected to the inputs "one" and "zero" of a bistable flip-flop 29, there being a monostable flip-flop 27 for the putting in to "one" of said bistable flip-flop.

The voicing decision signal P coming from the circuit 2 is applied to the integrators $25_1$ and $25_2$ to inhibit them in case of presence of unvoiced sound signal.

B. DETECTOR CIRCUIT OF THE INVENTION

Figure 3:
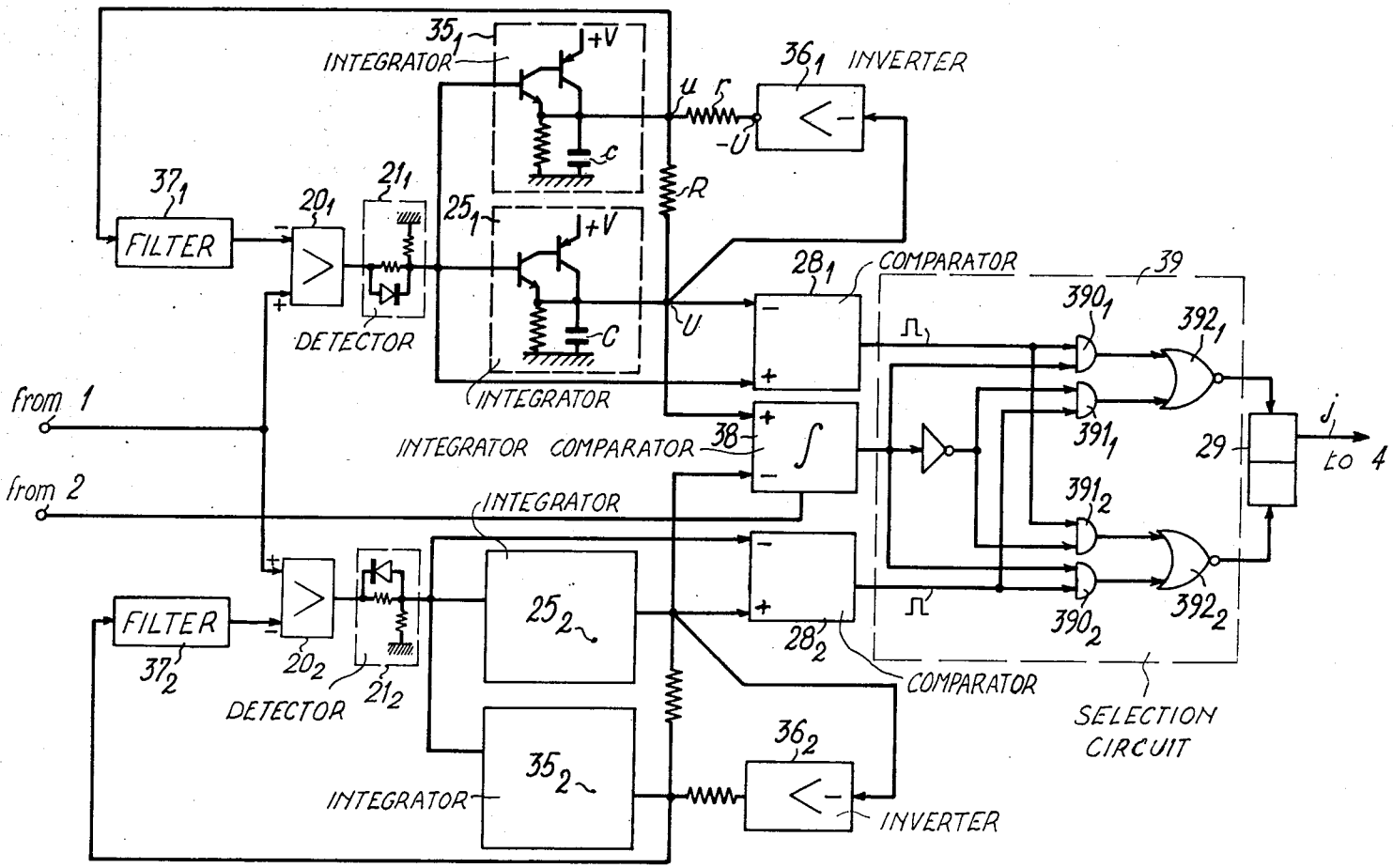
FIG. 3 shows the detection circuit for detecting significant peaks according to the present invention.

FIG. 3 shows the detection circuit for detecting significant peaks according to the invention.

In FIG. 3 are found the amplifiers $20_1$, $20_2$ and the detectors $21_1 21_2$ of the circuit of FIG. 2. The inverter 19 is omitted and the diodes of the detectors $21_1 21_2$ are oppositely poled, i.e., this is equivalent to using inverter 19. The output of the detector $21_1$ is, as in the prior art, connected to a comparator $28_1$ and to an integrator $25_1$ itself connected to the comparator $28_1$. The integrator $25_1$ is, as in FIG. 2 a circuit for storing of peak amplitudes; that is to say, when the amplitude of the output signal from $21_1$ increases, the output signal of $25_1$ follows its increase to a maximum, but when the output amplitude of $21_1$ decreases, the output signal of $25_1$ endeavours to hold the peak voltage in storage although somewhat decaying exponentially. In the FIG. 3 arrangement each chain comprises in addition a second circuit, respectively $35_1$ and $35_2$, for peak storage likewise connected to the detectors $21_1$ and $21_2$ respectively. The voltage U of the integrator $25_1$ discharges with a time constant RC of the order to 22ms, not to the earth, but to the output of the integrator $35_1$. The voltage $u$ of the integrator $35_1$ discharges at a time constant ($rc$) of the order of 2.4ms, not to the earth, but to a symmetric voltage U of the storage voltage $25_1$ with respect to the earth. This symmetric voltage with respect to the earth is obtained by means of the inverter amplifier $36_1$ of unity gain which reverses the output voltage U of the integrator $25_1$.

The output signal of the integrator $35_1$ is applied to a low pass filter $37_1$ which introduces a delay, and thereafter to the reverser input of the operational amplifier $20_1$. This feedback has the effect of weakening the output signal of $20_1$ after detection of a significant peak. This weakening goes on diminishing at the rhythm of the decay of the integrator $35_1$ until detection of a new significant peak.

The equality of the amplitudes of the output signals of the detector $21_1$ and of the integrator $25_1$ is detected in the comparator $28_1$ which delivers impulses at the positions of the significant peaks of the speech signal to be processed.

The processing chain of the negative peaks is, as stated, identical with that of the positive peaks and its circuits therefore are designated by the numeral references with the suffix 2.

Due to the asymmetry of the speech signal one of the chains gives a stronger response than the other. THe chain which senses the stronger peak of amplitudes takes precedence the stronger peaks having the larger difference of amplitude between the significant peaks and the non-significant peaks which precede them. The result is a greater output voltage from the integrator $25_1$ or from the integrator $25_2$.

The integrator comparator 38, the constant integration interval of which is of the order of 100ms, compares absolute values of the average integrals of these storage voltages. The response of comparator 38 is positive if the integrator 25 takes precedence, that is to say, if the positive going signals are the more favorable, and negative if the integrator $25_2$ takes precedence, that is to say, if the negative going signals are the more favorable.

The integrator comparator 38 controls a selection circuit 39 formed on one hand by the group comprising the two AND gates $390_1$ and $391_1$ and the OR gate $392_1$, and on the other hand by the group comprising the two AND gates $390_2$ and $391_2$ and the OR gate $392_2$, which groups give access respectively to the inputs one and zero of the flip-flop 29. It can be seen that if the integrator comparator output signal 38 is positive, the AND gates $390_1$ and $390_2$ are open and the putting into the state one of the flip-flop 29 is controlled by $28_1$ and its putting into the zero state by $28_2$ and if the integrator comparator output signal 38 is negative the AND gates $391_1$ and $391_2$ are open and the putting into the state one of the flip-flop 29 is controlled by $28_2$ and its putting into the state zeero by $28_1$.

FIG. 4A shows the equivalent electric diagram for the circuits $25_1$, $35_1$ and $36_1$ of FIG. 3. Let us designate by R, C resistance and condenser of the integrator $25_1$, $r$, $c$ resistance and condenser of the integrator $35_1$, I($p$) and U($p$) the current through and the voltage at the terminals of the condenser C, $i(p)$ and $u(p)$ the current through and the voltage at the terminals of the condenser $c$, and $p$ the Laplace variable, one finds $$I(p) = -\frac{Cp}{1 + (RC + rc + rC)\,p + Rr\,Ccp^2}\,U(p) \tag{1}$$

$$i(p) = \frac{(cp + RCcp^2)}{1 + (RC + rc + rC)\,p + Rr\,Ccp^2}\,U(p) \tag{2}$$

on the other hand $$U(p) = [I(p)/Cp] \tag{3}$$

By replacing U(p) by its value (3) in the equation (1), a differential equation of the second order with constant coefficients is obtained:

$$A_0p^2 + A_1p + A_2 = 0 \tag{4}$$

with $$\left.\begin{array}{l} A_o = Rr\,Cc \\ A_1 = RC'\,rc + rc \\ A_2 = 2 \end{array}\right\} \quad (5)\ ps$$

If $(-p_1)$ and $(-p_2)$ are the roots of the equation (4), the solution is:

$$U(t) = K_1 e^{-p_1 t} + K_2 e^{-p_2 t} \quad (6)$$

Application

R = 47 kΩ C = 0.47 μF R = 24kΩ c = 0.1 μF RC = 22.09ms rc = 2.4ms rC = 11.28ms

From which $A_o = 53ms^2$ $A_1 = 35.77ms$ $A_2 = 2$ $$53\,p^2 + 35.77\,p + 2 = 0 \quad (4')$$

$$p_1 = 0.613\ p_2 = 0.062$$

$$U(t) = K_1\,e^{-0.613t} + K_2\,r^{-0.062t} \quad (6')$$

$$U(t) = K_1\,e^{-\frac{t}{1.63}} + K_2\,e^{-\frac{t}{16.12}}$$

The integration constants $K_1$ and $K_2$ may be calculated by writing that:

$$U(0) = U_{max} \text{ and } [du/dt]_0 = 0$$

which gives $$U(t) = U_{max}\left[-0.11\,e^{-\frac{t}{1.63}} + 1.11\,e^{-\frac{t}{16.12}}\right] \quad (7)$$

where $U_{max}$ is the significant peak voltage and $t$ is expressed in milliseconds.

It can be shown in relation to FIG. 4B that the inverter amplifier 36 can be suppressed by earthing the end of the resistance $r$, which in FIG. 4A is brought to the potential − U. In this case the equation (4) is replaced by $$A'_o p^2 + A'_1 p + A'_2 = 0$$

with $$A'_o = R'r'C'c'$$

$$A'_1 = R'C' + r'c'\ 30\ r'C'$$

$$A'_2 = 1$$

In order that U' = U, it suffices to take $$R'r'C'c' = \tfrac{1}{2}\,R\,r\,C\,c$$

$$R'C' + r'C' + r'C'\ 32\ \tfrac{1}{2}\,(RC + rc + rC) \quad (8)$$

If one writes:

$RC = \Theta$ ; $rc = \theta$; $R'C' = \Theta'$; $r'c' = \theta$

C/c = a C'/c' = $\theta$ and if $\theta'$ is taken as unknown the conditions (8) are reduced to $$(1 + a')\,\theta'^2 - \tfrac{1}{2}\,[\Theta + (1 + a)\,\theta]\theta' + \tfrac{1}{2}\,\Theta.\,\theta = o \quad (9)$$

The equation (9) has two real roots if $$a' < \frac{[\Theta + (1 + a)\Theta]^2}{8\,\Theta\,\Theta} - 1$$

taking ti $a' = 1$

The equation (9) becomes $$2\theta'^2 - \tfrac{1}{2}[\Theta + (1 + a)\,\theta]\theta' + \tfrac{1}{2}\,\Theta,\theta = 1 \quad (10)$$

The roots of the equation (10) are $\Theta' = 3{,}76 \times 10^{31\,3}$ $\theta' = 7{,}05 \times 10^{-3}$

Application

R' = 37,6 kΩ C' = 0,1 μF r' = 70,5 kΩ c' = 0,1 μF

The signal (7) has for its Laplace transformed curve $$U(p) = \frac{p + p_1 + p_2}{(p + p_1)\,(p + p_2)} = \frac{p + A_1/A_0}{(p + p_1)\,(p + p_2)}$$

The signal $u(p)$ is related to U($p$) by $$u(p) = \frac{R - r}{R + r + Rrcp} \times U(p) = \frac{(R - r)/Rrc}{p + p_3} \times U(p) \text{ with } p_3 = \frac{R + r}{Rrc}$$

This relation permits of calculating without difficulties $u(t)$. It is found that $u(t)$ is a sum of three exponentials.

In FIG. 3 it is seen that it is the signal U($t$) which is compared with the speech signal processed and detected, and that it is the signal $u(t)$ which is subtracted from the non-detected speech signal. In FIG. 5A it is seen that in the absence of feedback several pitch impulses are found in a period between two significant peaks. However, in FIG. 5B which shows the case in which the filtered signal $u(t)$ is subtracted from the processed speech signal S, it is seen that the peaks following a significant peak are very considerably weakened. In determining judiciously the time constants $1/p_1$, $1/p_2$ and $1/p_3$ very much improved results are obtained compared with the case of using decreasing exponential curves having a single time constant at one and the same time for the comparison and weakening of the significant peaks, as done in the case of the prior art.

What I claim is:

1. A detection circuit for the detection of the significant peaks of a speech signal, comprising means for detecting the positive peaks and means for detecting the negative peaks of said speech signal, two peak charging circuits respectively associated with said detecting means, each of said peak charging circuits comprising a first integrator for storing peaks and providing a first relatively large discharge time constant, a comparator comparing the detected speech signal and the output signal of the said first integrator, and a second integrator for storing peaks and providing a second relatively smaller discharge time constant than said first discharge time constant, the discharge of said first integrator being effected up to a voltage equal to the output voltage of said second integrator during said first discharge time constant and the discharge of said second integrator being effected down to a voltage depending on the output voltage of said first integrator during said second discharge time constant.

2. A detection circuit according to claim 1, in which a discharge signal amplifier inverter is provided for reversing said output voltage of said first integrator, the discharge of said second integrator being effected down to the output voltage of said amplifier inverter.

3. A detection circuit according to claim 2, in which said discharge signal amplifier inverter has a gain equal to the unity.

4. A detection circuit according to claim 1, in which said output signal of each of said second integrator is subtracted from said speech signal, the subtracted signal being applied to said respective peak detecting means.

* * * * *